US009044685B2

(12) United States Patent
Alleshouse et al.

(10) Patent No.: US 9,044,685 B2
(45) Date of Patent: Jun. 2, 2015

(54) WATER ATTRACTIONS INVOLVING A FLOWING BODY OF WATER

(71) Applicant: Pacific Surf Designs, Inc., San Diego, CA (US)

(72) Inventors: Richard Alleshouse, San Diego, CA (US); Yong L Yeh, Foster City, CA (US)

(73) Assignee: Pacific Surf Designs, Inc., San Diego, CA (US)

( * ) Notice: Subject to any disclaimer, the term of this patent is extended or adjusted under 35 U.S.C. 154(b) by 0 days.

(21) Appl. No.: 14/052,726

(22) Filed: Oct. 12, 2013

(65) Prior Publication Data

US 2014/0106890 A1 Apr. 17, 2014

Related U.S. Application Data

(60) Provisional application No. 61/713,508, filed on Oct. 13, 2012.

(51) Int. Cl.
*A63G 21/18* (2006.01)
*A63G 31/00* (2006.01)

(52) U.S. Cl.
CPC ..... *A63G 31/007* (2013.01); *A63G 21/18* (2013.01)

(58) Field of Classification Search
CPC ..... A63G 21/00; A63G 31/18; A63G 31/00; A63G 31/02; A63G 31/007; A63H 23/00; A63H 23/10
USPC ..... 472/13, 117, 128; 4/488, 505
See application file for complete search history.

(56) References Cited

U.S. PATENT DOCUMENTS

| | | | | |
|---|---|---|---|---|
| 5,171,101 | A * | 12/1992 | Sauerbier et al. | 405/79 |
| 5,738,590 | A * | 4/1998 | Lochtefeld | 472/117 |
| 6,491,589 | B1 * | 12/2002 | Lochtefeld | 472/117 |
| 7,547,255 | B2 * | 6/2009 | Lochtefeld | 472/90 |
| 2009/0275416 | A1 * | 11/2009 | Murphy | 472/128 |
| 2013/0130815 | A1 * | 5/2013 | Lochtefeld | 472/128 |

* cited by examiner

*Primary Examiner* — Kien Nguyen
(74) *Attorney, Agent, or Firm* — Hudak Consulting Group LLC

(57) ABSTRACT

A water attraction, involving a flowing body of water, for performing board-riding maneuvers is described. A water attraction according to the present invention includes an activity section adjacent a safety chute; opposing sidewalls adjacent to a safety chute; a water delivery section creating water flow towards a safety chute; a water recovery section; and a rideable surface area. The rideable surface area further includes irregularly shaped surfaces with varying angles and elevations to increase difficulty and creativity in board-riding maneuvers.

19 Claims, 4 Drawing Sheets

WATER ATTRACTIONS INVOLVING A FLOWING BODY OF WATER

INCORPORATION BY REFERENCE

All publications and patent applications mentioned in this specification are herein incorporated by reference to the same extent as if each individual publication or patent application was specifically and individually indicated to be incorporated by reference.

FIELD OF INVENTION

This invention relates to the field of water attractions, and more specifically, to water rides involving a flowing body of water having sufficient characteristics, including area, speed and thickness, to allow for surfboard, skimboard, snowboard, skateboard, bodyboarding, bodysurfing, inner-tubing style maneuvers or other water riding maneuvers (collectively, "boardriding maneuvers").

BACKGROUND OF THE INVENTION

Conventional water attractions that allow for boardriding maneuvers, typically involve a flowing body of water. In these attractions, the flowing body of water is of such depth that the surface boundary layer effects of the flowing body of water over a limited number of wave forming surfaces significantly influence the rider's ability to perform boardriding maneuvers. Such "sheet flow" water attractions may simulate a stationary unbreaking ocean wave or, through the use of a naturally-occurring ocean wave shape, may create a stationary barreling wave.

Such existing "sheet flow" water attractions are limited in the number of boardriding maneuvers available to the rider as the shallow nature and speed of the flowing body of water and the limited number of wave forming surfaces restrict or limit the ability of the rider to perform a variety of boardriding maneuvers.

In addition, the number of riders capable of safely riding at one time on existing water attractions is limited due to design or physical limitations. Thus there is a need in the field of water attractions for new and useful water attractions that allow riders to perform a variety of boardriding maneuvers and allow for an increased number of riders to utilize the water attraction at one time in a manner that allows sufficient room for each individual rider to utilize the water attraction safely.

SUMMARY OF THE INVENTION

The present invention relates to water attractions involving a flowing body of water on a surface which preferably allows a rider or riders to engage in boardriding maneuvers on surfaces that are irregular and may not resemble naturally-occurring ocean wave shapes. Such irregular shapes may possibly include, but are not limited to: quarter-pipes; half-pipes; table-tops; bowls; ramps; spines; elbows; and other similar shapes. Such irregular shapes may include half-pipes in which the sidewalls are parallel and/or non-parallel or a combination of both. Due to the nature of a flowing body of water, the sidewalls of the present invention are generally non-parallel to allow for the rider(s) to take advantage of more of the surface area of each sidewall. In existing "half-pipe" water attractions with parallel or substantially parallel sidewalls, the rider(s) is unable to take full advantage of the sidewall's surface area from the transition up to the lip line due to the characteristics of water flowing in the vertical direction. In addition, the different forms of irregular shapes may be used independently or in conjunction or in combination with each other to create additional irregular shapes. Furthermore, shapes may be combined at varying angles and elevations to create surfaces allowing for boardriding maneuvers of increasing difficulty and creativity.

DETAILED DESCRIPTION OF SOME EMBODIMENTS

The following description of the preferred embodiments of the invention is not intended to limit the invention to this preferred embodiment, but rather to enable any person skilled in the art to make and use this invention.

Figure 1:
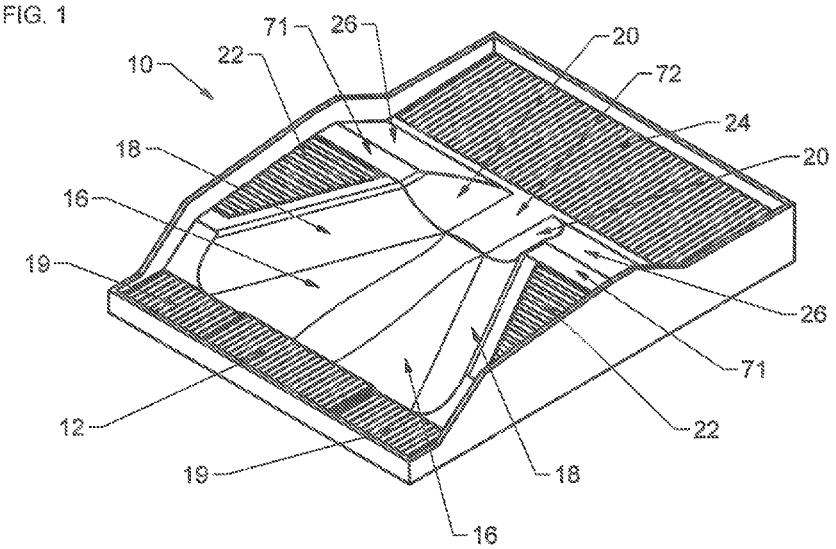
FIG. 1 is an isometric view of the present invention in the first variation depicting a half-pipe shape.
Figure 2:
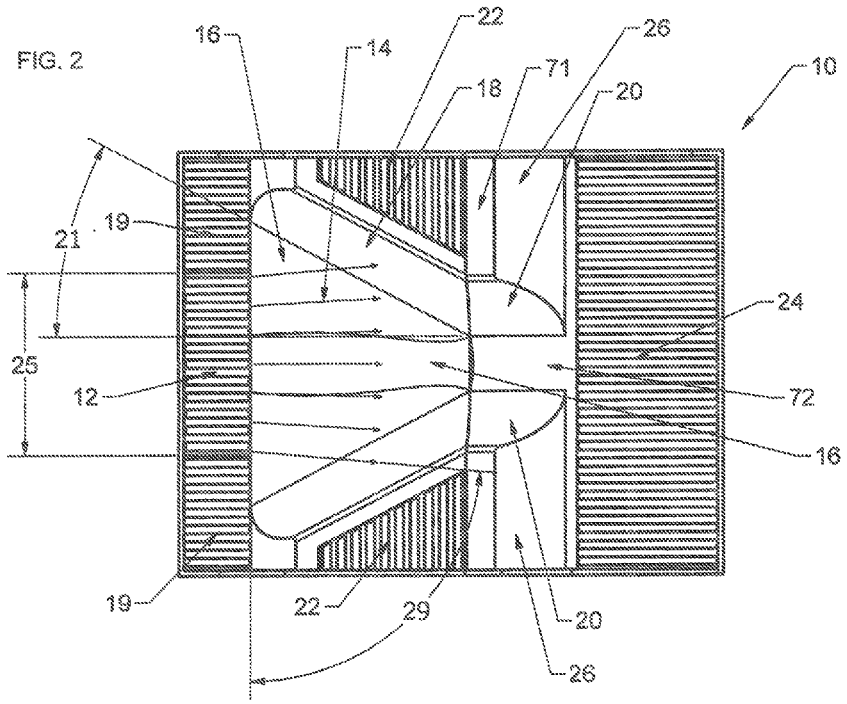
FIG. 2 is a top view of the present invention of FIG. 1.
Figure 3:
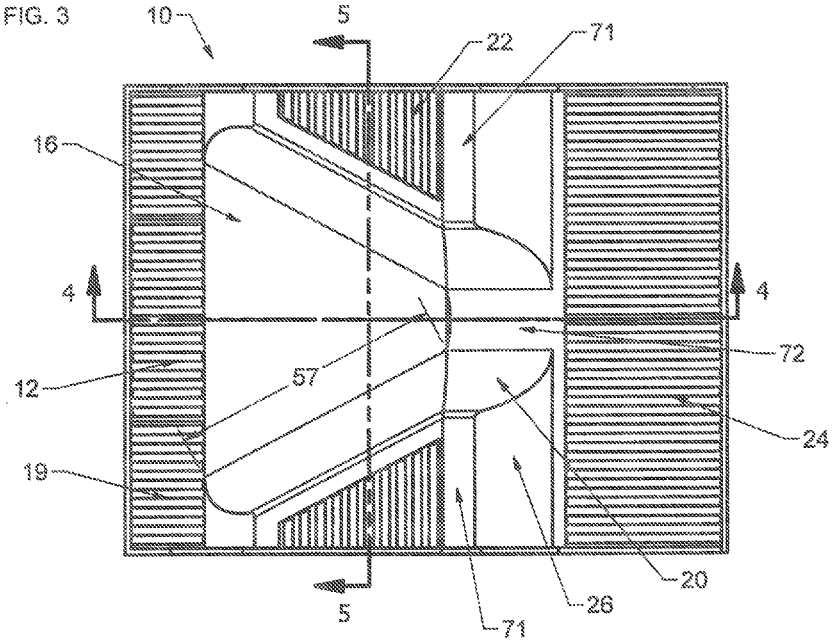
FIG. 3 is another top view of the present invention of FIG. 1.

Referring now to the invention in more detail, as shown in FIGS. 1-3, half-pipe water attraction 10 of a preferred embodiment includes sidewalls 18 adjacent to middle section 16 and sidewalls 20 adjacent to safety chute section 72. The sidewalls 18 and 20 may be either parallel or non-parallel sidewalls. The water attraction of the preferred embodiment preferably enables one or more riders to perform boardriding maneuvers. In some embodiments, as shown in FIG. 2, the water attraction 10 may further include a water delivery system 12. The water delivery system 12 preferably functions to create a flowing body of water moving in the direction of arrows 14 toward a safety chute section 72. The flowing body of water may flow over the middle section 16, over each sidewall 18, over each sidewall 20, to elevated water recovery sections 22, located at an elevation above where the sidewalls 18 terminate, to safety transition section 71, down declined sections 26, and to a water recovery section 24 in the rear of the embodiment, in which such water recovery section 24 may be at an elevation above or below the water delivery system 12. The water collected in the water recovery sections 22 and 24 may flow into a water retrieval section 30 (shown in FIG. 4) and returned to the water delivery system 12. The water delivery system 12 may include a pump or other fluid accelerating device. The water attraction 10 of the preferred embodiments preferably functions to enable a rider or riders to engage in boardriding maneuvers on surfaces that are irregular and may not resemble naturally-occurring ocean wave shapes. Such irregular shapes may possibly include, but are not limited to: quarter-pipes; half-pipes; table-tops; bowls; ramps; spines; elbows; and other similar shapes. Such irregular shapes may include half-pipes in which the sidewalls are parallel and/or non-parallel or a combination of both. In addition, the different forms of irregular shapes may be used independently or in conjunction or in combination with each other to create additional irregular shapes. Furthermore, shapes may be combined at varying angles and elevations to create surfaces allowing for boardriding maneuvers of increasing difficulty and creativity. Furthermore, water attraction 10 of the preferred embodiments, preferably functions to enable an increased number of riders to utilize the water attraction at the same time in a manner that allows sufficient room for each individual rider to utilize the water attraction safely.

In more detail, still referring to the invention of FIGS. 1-3, there is shown an embodiment allowing a rider to perform boardriding maneuvers on the middle section 16 and each sidewall 18. The sidewalls 18 or 20 may be concave, planar or convex, or a combination of the aforementioned and may have the same radius of curvature or slope, or, in other embodiments, the non-planar sidewalls may have a varying radius of curvature or slope. The flowing body of water 14 creates an activity section by flowing onto both the middle section 16 and either or both sidewalls 18 in which a rider may perform boardriding maneuvers on the middle section 16 and on either or both sidewalls 18 in a continuous and unimpeded manner. The activity section may include surfaces that are irregular and may not resemble naturally-occurring ocean wave shapes. Such irregular shapes may possibly include, but are not limited to: quarter-pipes, half-pipes, table-tops, bowls, ramps, spines, elbows and other similar shapes. Such irregular shapes may include half-pipes in which the sidewalls 18 and 20 are parallel and/or non-parallel or a combination of both. In addition, the different forms of irregular shapes may be used independently or in conjunction or in combination with each other to create additional irregular shapes. Furthermore, shapes may be combined at varying angles and elevations to create surfaces allowing for boardriding maneuvers of increasing difficulty and creativity.

As shown in FIGS. 1-2, a rider exiting the activity section may be swept upon either water recovery section 22 and possibly upon safety transition section 71, down declined sections 26, and/or upon safety chute section 72, to water recovery section 24. The water recovery sections may include a surface having a plurality of apertures or slots. The water may flow through the slots or apertures such that it may be recovered and recycled through the system. The slots or apertures may be sized and configured such that a rider may safely stand or ride on the water recover section without tripping on or falling through the slots or apertures. A rider performing boardriding maneuvers upon the sidewall 18 may exit the activity section upon water recovery section 22, upon safety transition section 71, and possibly down declined section 26. A rider performing boardriding maneuvers upon the middle section 16 may exit the activity section upon the safety chute section 72 and/or water recovery section 24. The safety chute section 72 and the sidewalls 20 are designed to safely transition riders to the water recovery section 24.

In further detail, still referring to the invention of FIGS. 1-3, the surface of water attraction 10 is sufficiently smooth such that a rider may be safely swept over the surfaces of the water attraction including the middle section 16, sidewalls 18, water recovery sections 22, sidewalls 20, declined sections 26, safety transition section 71, safety chute section 72, and to water recovery section 24.

Figure 4:
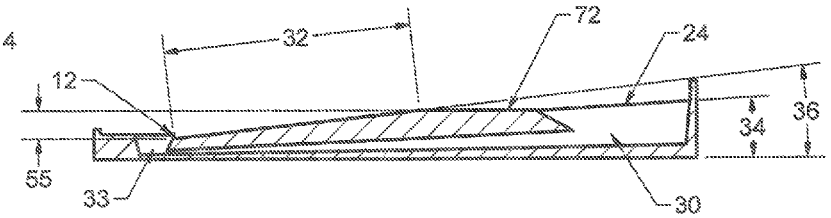
FIG. 4 is a longitudinal cross-section of the present invention of FIG. 1.
Figure 5:
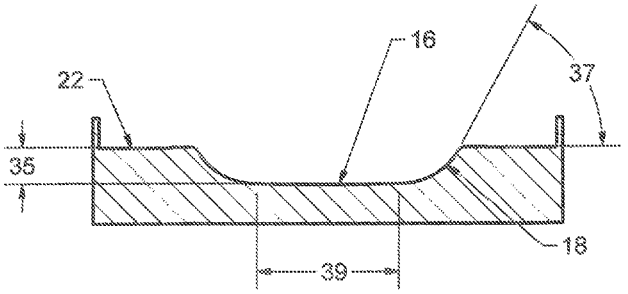
FIG. 5 is a transverse section of the present invention of FIG. 1.

In order to construct the water attraction 10 of adequate size to fully accommodate individual and multiple riders, for purposes of scale and not limitation, referring to FIGS. 4 and 5, the dimensions of the middle section, which may be either planar or non-planar, 16 can be between 1 and 50 meters in length 32, between 0.05 and 5 meters in height 55, and between 1 and 30 meters in width 39, although the width may be of such distance that is only limited by physical and cost restrictions. The height 35 of the sidewalls 18 can vary from 0.2 and 5 meters in height. As shown in FIG. 2, the downstream angle 21 of the sidewalls 18 can vary from 10 degrees to 60 degrees off from the sidewalls 20. The middle section 16 can be planar or slightly curved or curved.

The water attraction 10, including the activity section, may be made from a rigid or substantially rigid substrate such as concrete, metal, fiberglass, plastic or other similar material. The rigid or substantially rigid material may be covered in a layer of impact resistant padding covered with a substantially waterproof membrane and/or sealant.

Referring now to FIG. 3, there is shown a top view of the preferred embodiment 10, with section views 4 and 5, shown in FIGS. 4 and 5 respectively. Now referring to FIG. 4, depicting a longitudinal section view 4 through the water attraction 10, the water recovery section 24, feeds a water retrieval section 30 which functions to catch the water from the water recovery section 24 and allow the water to return to the front of the attraction where it can be redirected through the water directing mechanism 33, such as a nozzle, and re-distributed onto the ride surface 16 and either or both sidewalls 18 by the water delivery system 12. Although not depicted in the FIGURES, the water recovery section 22 also feeds a water retrieval section which allows water to return to the front of the attraction where it can be redirected through the water direction mechanism 33 and re-distributed onto the ride surface 16 and either or both sidewalls 18 by the water delivery system 12. The inclination 36, of the ride surface 16, can vary substantially from horizontal to an angle of 45°. The inclination 34 of the water recovery section 24, which drains water originating from the water delivery system 12, in which such water flows without a significant "change in direction." In this case, a "change in direction" is defined as altering the original flow direction by more than 160° in a plane substantially defined by the sheet of flowing water, before entering either water recovery section 22 or 24. The inclination 34 of the water recovery section may be between 0° and 30°.

Referring now to the transverse section through the preferred embodiment 10 in FIG. 5, there is a width component 39, to the middle section 16, which separates the sidewalls 18. The middle section 16 can be slightly curved or substantially planar. The sidewalls 18 can be shaped as a curve, including convex, concave, ellipse, complex curve shapes, or can be substantially planar depending on the desired ride shape. The final angle of inclination 37 of the sidewall 18 can vary significantly from 5° to a maximum of 150°, in which case the sidewall 18 may extend vertically over a portion of itself. Furthermore, the final angle of inclination may vary along the length 57 (as shown in FIG. 3) of the sidewall 18 and can be increasing, decreasing, or varying. The height 35 of the sidewalls 18 can vary between 0.05 meters and 10 meters. Furthermore, the height 35 of the sidewall 18 can vary along the length of a single sidewall 18 by increasing the height, decreasing the height, or a combination thereof along the length 57 of the sidewall 18 and can vary significantly from one sidewall 18 to the opposing sidewall 18. The length 57 of each respective sidewall 18 can vary significantly from a length of 1 meter to 50 meters, and other embodiments may have opposing sidewalls of different lengths.

Figure 6:
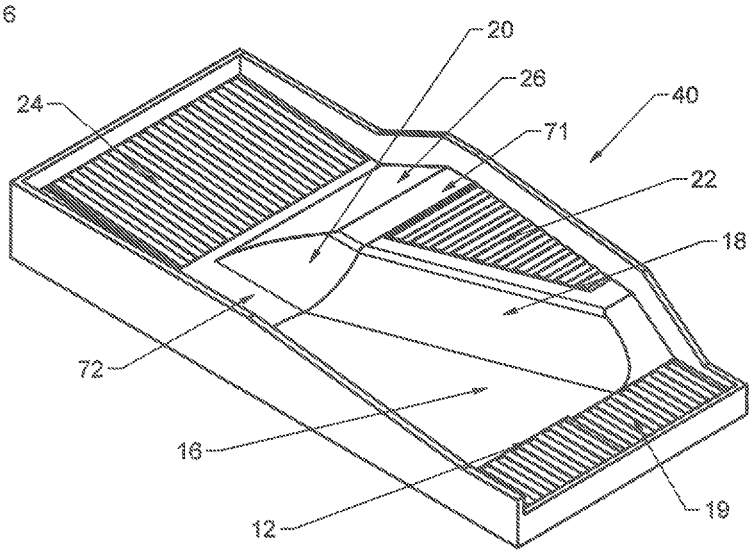
FIG. 6 is an isometric view of the first variation of the water attraction depicting a quarter-pipe.
Figure 7:
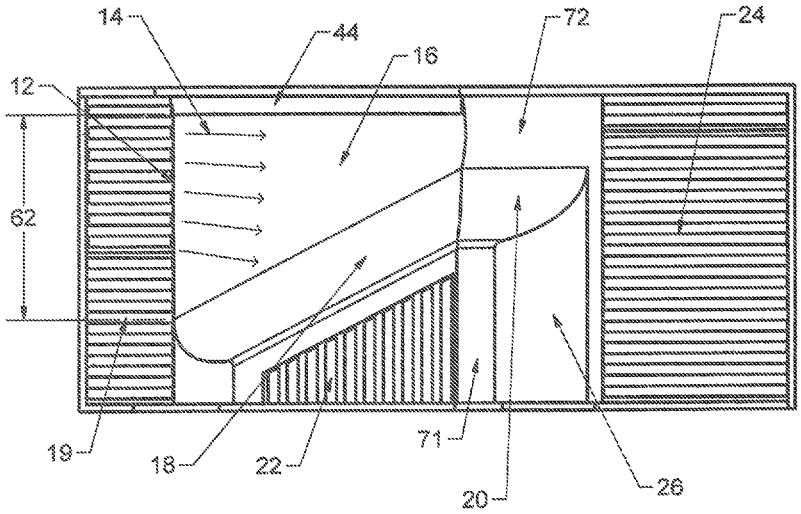
FIG. 7 is a top view of the present invention of FIG. 6.
Figure 8:
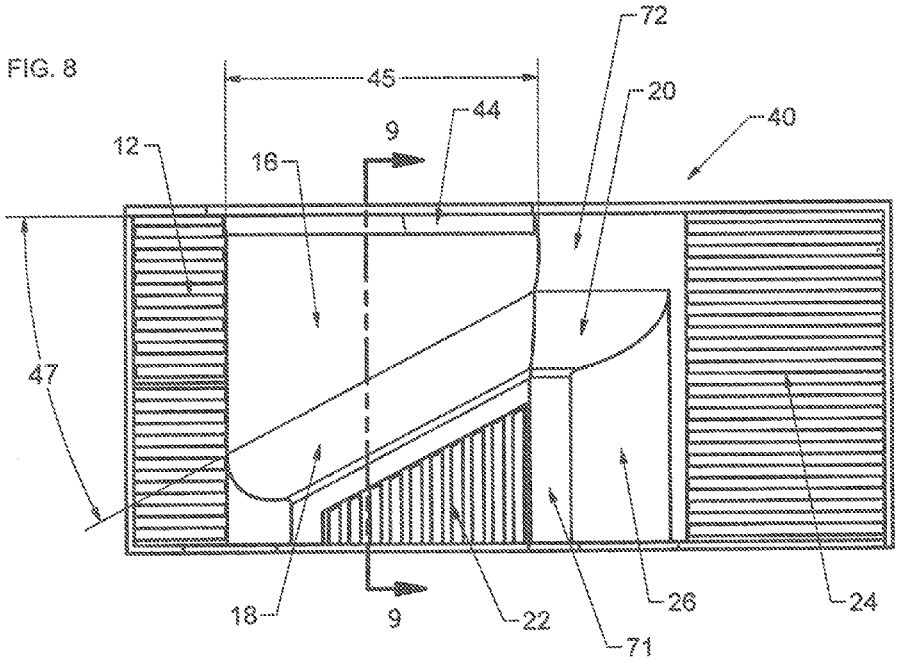
FIG. 8 is a top view of the present invention of FIG. 6.

Referring now to the invention as shown in FIGS. 6-8, an alternative preferred embodiment of the water attraction includes a sidewall 18, a sidewall 20, a water recovery section 22, a safety transition section 71, and a declined section 26 forming a quarter-pipe 40. On the opposite side of the sidewalls 18 and 42 of quarter-pipe 40, there is an angled sidewall 44 provided for safety purposes. The safety chute section 72, sidewall 20 and a sidewall opposite sidewall 20 are designed to safely transition riders to the water recovery section 24.

Figure 9:
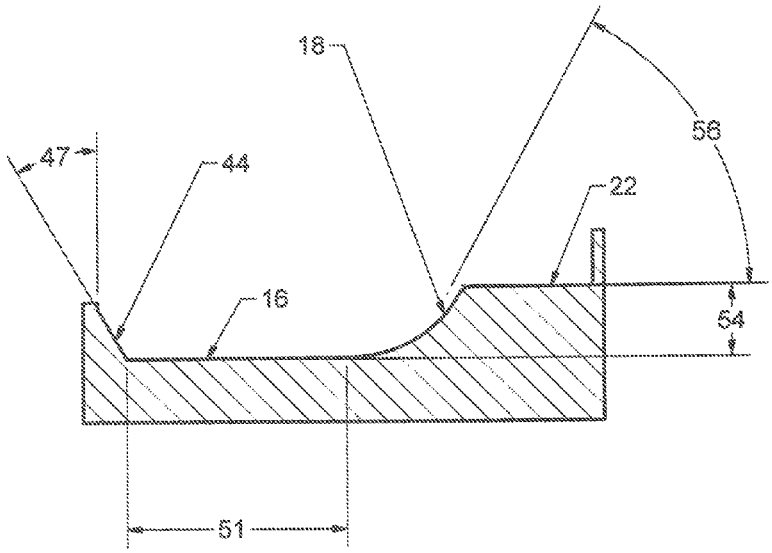
FIG. 9 is a transverse section of the activity section of the present invention in FIG. 6.

As shown in FIG. 7, the width of the middle section 16 is of a width 62 that is only limited by cost and space restrictions. In this embodiment, the sidewall 18 may be oriented in such a way to the middle section 16 and the flow of water 14 such that one or more riders may perform boardriding maneuvers. The general operating characteristics of the quarter pipe embodiment 40 are similar to the first preferred embodiment 10 in which the water recovery section 24 feeds the water retrieval section 30 (as shown in FIG. 4), which feeds the water directing mechanism 33 (as shown in FIG. 4), which then feeds the flow of water 14 onto the middle section 16 and sidewall 42 via the water delivery system 12. Furthermore, as shown in FIG. 9, the angle 47 of the sidewall 18 can vary significantly, similarly to previously described angle 21 in the first preferred embodiment 10. Furthermore, the height 54 of the final angle of inclination 56 may vary as described previously with respect to the first preferred embodiment 10 as may the height, width and lengths of the respective surfaces.

Additional embodiments of this invention over which a body of water flows and creates a shape that appears in skateboard, snowboard and other action sports parks such as a bowl, hip, elbow, spine, and other shapes, may allow a rider or riders to ride up inclined sidewalls, substantially change directions, travel down the respective sidewall, across substantially flat or curved middle sections or other connection sidewalls, up separate sidewalls to once again substantially change direction, ride down the respective sidewall and back onto substantially flat middle sections. The body of water, after flowing over any substantially flat or curved middle sections and inclined sidewall(s), then may travel onto a water recovery section to be reused. In addition, such additional surface shapes may have a flowing body of water created by a water delivery system moving in a number of different directions and such water delivery system is configured in a manner that allows for a flowing body of water to travel over such additional surface shapes.

As a person skilled in the art will recognize from the previous detailed description and from the figures and claims, modifications and changes can be made to the preferred embodiments of the invention without departing from the scope of this invention defined in the following claims. Those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A water attraction involving a flowing body of water on a surface configured for a rider or riders to engage in boardriding maneuvers, said water attraction comprising:

an activity section comprising:

a middle section adjacent to at least one safety chute section; and a plurality of opposing parallel or non-parallel sidewalls, wherein the plurality of sidewalls are adjacent to the middle section and to the at least one safety chute section;

a water delivery section, wherein the water delivery section creates a flowing body of water over the middle section towards the at least one safety chute section;

a rideable surface on the plurality of side walls and the middle section, wherein the rideable surface is configured such that a rider or riders may ride up and down the plurality of sidewalls and over the middle section; and a plurality of elevated water recovery sections positioned above the plurality of sidewalls.

2. The water attraction of claim 1, wherein the plurality of opposing non-parallel sidewalls adjacent to the middle section are any shape chosen from a group consisting of one or more of: concave, planar, substantially planar, convex, ellipse, and complex curve shapes.

3. The water attraction of claim 2, wherein a height of the plurality of sidewalls is between 0.05 meters and 10 meters.

4. The water attraction of claim 3, wherein the height of the plurality of sidewalls varies along the length of a single sidewall and further varies between a first sidewall to a second opposing sidewall.

5. The water attraction of claim 2, wherein a length of each sidewall is between 1 meter and 50 meters.

6. The water attraction of claim 1, wherein a final angle of inclination of each of the plurality of sidewalls is between a minimum of 5° and a maximum of 150°.

7. The water attraction of claim 6, wherein when the plurality of sidewalls has the final angle of inclination of 150°, each of the plurality of sidewalls extends vertically over a portion of itself.

8. The water attraction of claim 1, wherein a final angle of inclination varies along a length of each of the plurality of sidewalls.

9. The water attraction of claim 1, wherein the plurality of sidewalls adjacent to the middle section each have the same radius or curvature or slope.

10. The water attraction of claim 1, wherein the plurality of sidewalls adjacent to the at least one safety chute section each have the same radius or curvature or slope.

11. The water attraction of claim 1, wherein the elevated water recovery sections each includes a declined section leading to a second water recovery section in a rear portion of the water attraction.

12. The water attraction of claim 11, wherein the second water recovery section is at an elevation that differs from an elevation of the water delivery system.

13. The water attraction of claim 1, wherein the water recovery sections include a surface having a plurality of apertures or slots.

14. The water attraction of claim 1, wherein the rideable surface of the water attraction is sufficiently smooth enough to enable a rider or riders to be swept over the surfaces of the water attraction.

15. The water attraction of claim 1, wherein the activity section comprises a rigid or substantially rigid substrate.

16. The water attraction of claim 15, wherein the rigid or substantially rigid substrate is covered in a layer of impact resistant padding covered with a substantially waterproof membrane and/or sealant.

17. The water attraction of claim 1, wherein the middle section is slightly curved or substantially planar.

18. A water attraction involving a flowing body of water on a surface configured for a rider or riders to engage in boardriding maneuvers, said water attraction comprising:

a plurality of middle areas with a planar, curved or complexly curved geometry;

a plurality of opposing sidewall areas with either constant or varying geometry along their length;

a water delivery section, wherein the water delivery section creates a flowing body of water over the plurality of middle and sidewall areas;

at least one water recovery area adjacent to either the plurality of middle or sidewall areas;

a rideable surface on the plurality of middle and sidewall areas, wherein the rideable surface is configured such that a rider or riders may ride up and down the plurality of sidewall areas and over the middle areas; and additional sidewall areas, opposing or non-opposing, extending from the plurality of sidewall areas.

19. The water attraction of claim 18, wherein the at least one water recovery area is coupled to the plurality of sidewall areas.

* * * * *